US010655902B2

(12) United States Patent
Saito

(10) Patent No.: US 10,655,902 B2
(45) Date of Patent: May 19, 2020

(54) ICE MAKING DEVICE

(71) Applicant: NIDEC SANKYO CORPORATION, Nagano (JP)

(72) Inventor: Shunji Saito, Nagano (JP)

(73) Assignee: NIDEC SANKYO CORPORATION, Nagano (JP)

( * ) Notice: Subject to any disclaimer, the term of this patent is extended or adjusted under 35 U.S.C. 154(b) by 88 days.

(21) Appl. No.: 16/116,943

(22) Filed: Aug. 30, 2018

(65) Prior Publication Data

US 2019/0063809 A1 Feb. 28, 2019

(30) Foreign Application Priority Data

Aug. 31, 2017 (JP) ..... 2017-166785

(51) Int. Cl.
*F25C 1/04* (2018.01)
*F25C 5/06* (2006.01)
*F25D 23/06* (2006.01)

(52) U.S. Cl.
CPC ..... *F25C 1/04* (2013.01); *F25C 5/06* (2013.01); *F25D 23/067* (2013.01); *F25D 2400/40* (2013.01)

(58) Field of Classification Search
CPC ..... F25C 1/04; F25C 5/06; F25C 1/10; F25C 1/24; F25C 2305/022
See application file for complete search history.

(56) References Cited

U.S. PATENT DOCUMENTS 4,665,708 A * 5/1987 Tate, Jr. ..... F25C 1/04 62/66
4,833,894 A * 5/1989 Chesnut ..... F25C 1/04 219/421
6,438,988 B1 * 8/2002 Paskey ..... F25C 1/04 62/353
2010/0005818 A1 * 1/2010 Saito ..... F25C 1/04 62/137

(Continued)

FOREIGN PATENT DOCUMENTS

EP 2562494 A2 * 2/2013 ..... F25C 5/06
JP 2011089758 5/2011
JP 2015132448 7/2015

*Primary Examiner* — Kun Kai Ma
(74) *Attorney, Agent, or Firm* — JCIPRNET

(57) ABSTRACT

To provide an ice making device in which a drive unit causes an ice making tray to perform a twist operation, and even if a penetration part through which a wiring that extends from the drive unit is drawn from the inside to the outside is provided in a side plate of a frame, it is possible to prevent damage to the side plate. An ice making device is provided. In the ice making device, an ice making tray and a drive unit are supported by a frame. In the frame, in a first side plate, a plurality of attachment parts for installing the frame to a refrigerator main body and a penetration part penetrating through the first side plate in the first direction are provided. The penetration part is provided in the first side plate on the other side relative to the attachment part furthest on one side in the first direction. A wiring includes a first drawing part that extends from the drive unit along an inner wall of the first side plate and a second drawing part that is drawn to the outside through the penetration part.

10 Claims, 7 Drawing Sheets

(56) References Cited

U.S. PATENT DOCUMENTS

| | | | | |
|---|---|---|---|---|
| 2010/0218524 | A1* | 9/2010 | Saito | F25D 23/12 62/135 |
| 2016/0054042 | A1* | 2/2016 | May | F25C 1/04 62/340 |
| 2016/0116199 | A1* | 4/2016 | Fischer | F25C 5/185 62/344 |

* cited by examiner

ICE MAKING DEVICE

CROSS-REFERENCE TO RELATED APPLICATION

This application claims the priority of Japan patent application serial no. 2017-166785, filed on Aug. 31, 2017. The entirety of the above-mentioned patent application is hereby incorporated by reference herein and made a part of this specification.

BACKGROUND

Technical Field

The disclosure relates to an ice making device in which a drive unit causes an ice making tray to perform an inversion operation and a twist operation.

Related Art

In an ice making device mounted on a refrigerator, when water in a water supply tank is filled into a recessed part for water storage of an ice making tray through a water supply pipe and ice making is completed, a drive unit inverts and twists an ice making tray around an axis that extends in a first direction and thus causes ice to fall into an ice storage container. Here, the drive unit is disposed on one side of the ice making tray in the first direction, and is supported by a common frame together with the ice making tray. The frame includes a first side plate and a second side plate on both sides in a second direction (width direction) crossing the first direction of the ice making tray. An ice detection lever is disposed between the second side plate of the frame and the ice making tray, and when the ice making device is mounted on the refrigerator, the first side plate is fixed to the refrigerator main body. The drive unit uses a motor as a driving source, and power is supplied through a wiring drawn from the drive unit to the outside of the frame.

In ice making devices described in Japanese Laid-open publication No. 2011-89758 and Japanese Laid-open publication No. 2015-132448, when a wiring is not supported by a frame and is directly drawn from a drive unit to the outside of the frame, much time and effort is required for handling the wiring. Thus, providing a penetration part in a first side plate, drawing the wiring along an inner surface of the first side plate of the frame to an intermediate part, and drawing the wiring to the outside of the frame through the penetration part can be considered. In this case, since the intermediate part of the wiring is supported by the penetration part of the first side plate, a wiring disposed outside the frame is shortened, and thus handling of the wiring and the like become easier. However, in an ice making device type in which a drive unit causes an ice making tray to perform a twist operation, since a large force is applied to the frame when the drive unit causes the ice making tray to perform a twist operation, when a penetration part is forming in the first side plate, in the first side plate, stress is concentrated in the vicinity of the penetration part and the first side plate may be damaged.

SUMMARY

An embodiment of the disclosure provides an ice making device including an ice making tray in which recessed parts for water storage are disposed upward; a drive unit that is disposed on one side of the ice making tray in a first direction crossing a vertical direction and causes the ice making tray to perform an inversion operation and a twist operation around an axis that extends in the first direction; a frame that includes a side plate that extends in the first direction along a side surface on one side of the ice making tray in a second direction crossing the vertical direction and the first direction and supports the ice making tray and the drive unit; and a wiring that extends from the drive unit, wherein a plurality of attachment parts and a penetration part are provided in the side plate. The attachments parts for installing the frame to a refrigerator main body is provided in the side plate on an other side of the drive unit in the first direction. The penetration part penetrates through the side plate in the second direction on the other side in the first direction relative to an attachment part provided furthest on one side in the first direction among the plurality of attachment parts. The wiring includes a first drawing part that extends from the drive unit along an inner wall of the side plate on which the ice making tray is disposed and a second drawing part that is drawn out to a side opposite to the ice making tray with respect to the side plate through the penetration part.

DESCRIPTION OF THE EMBODIMENTS

Figure 1:
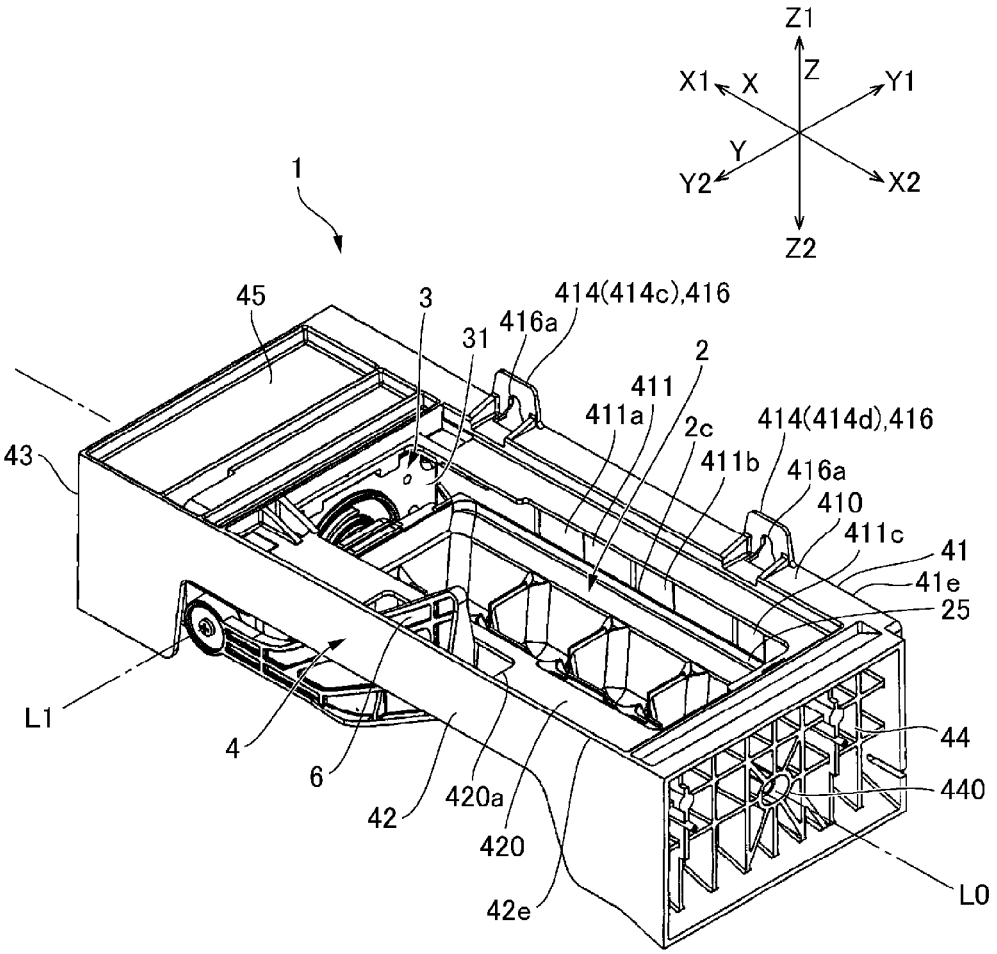
FIG. 1 is a perspective view of an ice making device to which an embodiment of the disclosure is applied when viewed from the side on which a second side plate is disposed and viewed obliquely from above.

The embodiments of the disclosure provides an ice making device in which a drive unit causes an ice making tray to perform a twist operation, and even if a penetration part through which a wiring that extends from the drive unit is drawn from the inside to the outside is provided in a side plate of a frame, it is possible to prevent damage to the side plate.

In an embodiment of the disclosure, the penetration part is provided in the side plate, the wiring is drawn along an inner surface of the side plate of the frame to an intermediate part, and the wiring is drawn to the outside of the frame through the penetration part. Therefore, since the intermediate part of the wiring is supported by the penetration part of the side plate, a wiring disposed outside the frame is shortened. Accordingly, handling of the wiring and the like become easier. In addition, in an ice making device type in which a drive unit causes an ice making tray to perform a twist operation, a large force is applied to the frame when the drive unit causes the ice making tray to perform the twist operation. However, in the side plate, among the plurality of attachment parts provided on the other side of the drive unit in the first direction, a penetration part is provided on the other side in the first direction relative to an attachment part provided furthest on one side in the first direction. Therefore, transmission of a force applied to the frame at a side of the penetration part can be prevented by the attachment parts fixed to the refrigerator main body on one side in the first direction when the drive unit causes the ice making tray to perform a twist operation. Accordingly, in the side plate, since it is possible to prevent concentration of stress in the vicinity of the penetration part, it is possible to prevent damage to the side plate.

In an embodiment of the disclosure, the second drawing part includes a third drawing part that extends along an outer wall of the side plate that is at a side opposite to the ice making tray. In the side plate, a wiring supporting part that supports the third drawing part is provided. According to this embodiment, since a wiring part that is free outside the frame is shortened, handling of the wiring and the like become easier. In an embodiment, the wiring supporting part elastically presses the third drawing part against the outer wall. According to this embodiment, when the third drawing part is passed between the outer wall and the wiring supporting part, since the third drawing part is supported by the side plate, the third drawing part is easily supported.

In an embodiment of the disclosure, the penetration part is a notch that is provided at a lower end or an upper end of the side plate. In an embodiment of the disclosure, the notch is provided at the lower end of the side plate.

In an embodiment of the disclosure, the plurality of attachment parts include at least a lower end side attachment part formed at the lower end of the side plate, and the lower end side attachment part is provided on one side of the penetration part in the first direction.

In an embodiment of the disclosure, the plurality of attachment parts include at least a plurality of lower end side attachment parts formed at the lower end of the side plate, and the penetration part is provided between lower end side attachment parts adjacent to each other in the first direction among the plurality of lower end side attachment parts.

In an embodiment of the disclosure, the plurality of attachment parts include a lower end side attachment part formed at the lower end of the side plate and an upper end side attachment part formed at the upper end of the side plate and the penetration part is provided between the lower end side attachment part and the upper end side attachment part adjacent to each other in the first direction.

In an embodiment of the disclosure, on the inner wall, a plurality of inner wall side reinforcing ribs that extend in the vertical direction are formed along the first direction, among the plurality of inner wall side reinforcing ribs, a first inner wall side reinforcing rib formed on one side of the notch in the first direction extends halfway toward the lower end from a side of the upper end of the side plate and a second inner wall side reinforcing rib formed on an other side of the notch in the first direction reaches the lower end from a side of the upper end of the side plate, and the first drawing part extends along the inner wall between the first inner wall side reinforcing rib and the lower end of the side plate. According to this embodiment, the strength of the side plate can be increased by the inner wall side reinforcing rib while a space in which the first drawing part is disposed is secured.

In an embodiment of the disclosure, on an outer wall of the side plate opposite to the ice making tray, a plurality of outer wall side reinforcing ribs that extend in the vertical direction are formed along the first direction, and among the plurality of outer wall side reinforcing ribs, a first outer wall side reinforcing rib formed on one side of the notch in the first direction reaches the lower end from a side of the upper end of the side plate and a second outer wall side reinforcing rib formed on an other side of the notch in the first direction extends halfway toward the lower end from a side of the upper end of the side plate. According to this embodiment, the strength of the side plate can be increased by the outer wall side reinforcing rib while a space in which a part of the second drawing part extends to the other side in the first direction along the outer wall is secured.

In the embodiments of the disclosure, the penetration part is provided in the side plate, the wiring is drawn along an inner surface of the side plate of the frame to an intermediate part, and the wiring is drawn to the outside of the frame through the penetration part. Therefore, since the intermediate part of the wiring is supported by the penetration part of the side plate, a wiring disposed outside the frame is shortened. Accordingly, handling of the wiring and the like become easier. In addition, in an ice making device type in which a drive unit causes an ice making tray to perform a twist operation, a large force is applied to the frame when the drive unit causes the ice making tray to perform a twist operation. However, in the side plate, among the plurality of attachment parts provided on the other side of the drive unit in the first direction, a penetration part is provided on the other side in the first direction relative to an attachment part provided furthest on one side in the first direction. Therefore, transmission of a force applied to the frame when the drive unit causes the ice making tray to perform a twist operation to the side of the penetration part of the side plate can be prevented by the attachment part fixed to the refrigerator main body on one side in the first direction. Accordingly, in the side plate, since it is possible to prevent concentration of stress in the vicinity of the penetration part, it is possible to prevent damage to the side plate.

Embodiments of the disclosure will be described with reference to the drawings. In the following description, three directions that cross each other will be described as a first direction X (length direction), a second direction Y (width direction), and a third direction Z (vertical direction). In addition, in the description, X1 refers to one side in the first direction X, X2 refers to the other side in the first direction X, Y1 refers to one side in the second direction Y, Y2 refers to the other side in the second direction Y, Z1 refers to one side (upper side) in the third direction Z (vertical direction), and Z2 refers to the other side (lower side) in the third direction Z (vertical direction).

(Overall Configuration)

Figure 2:
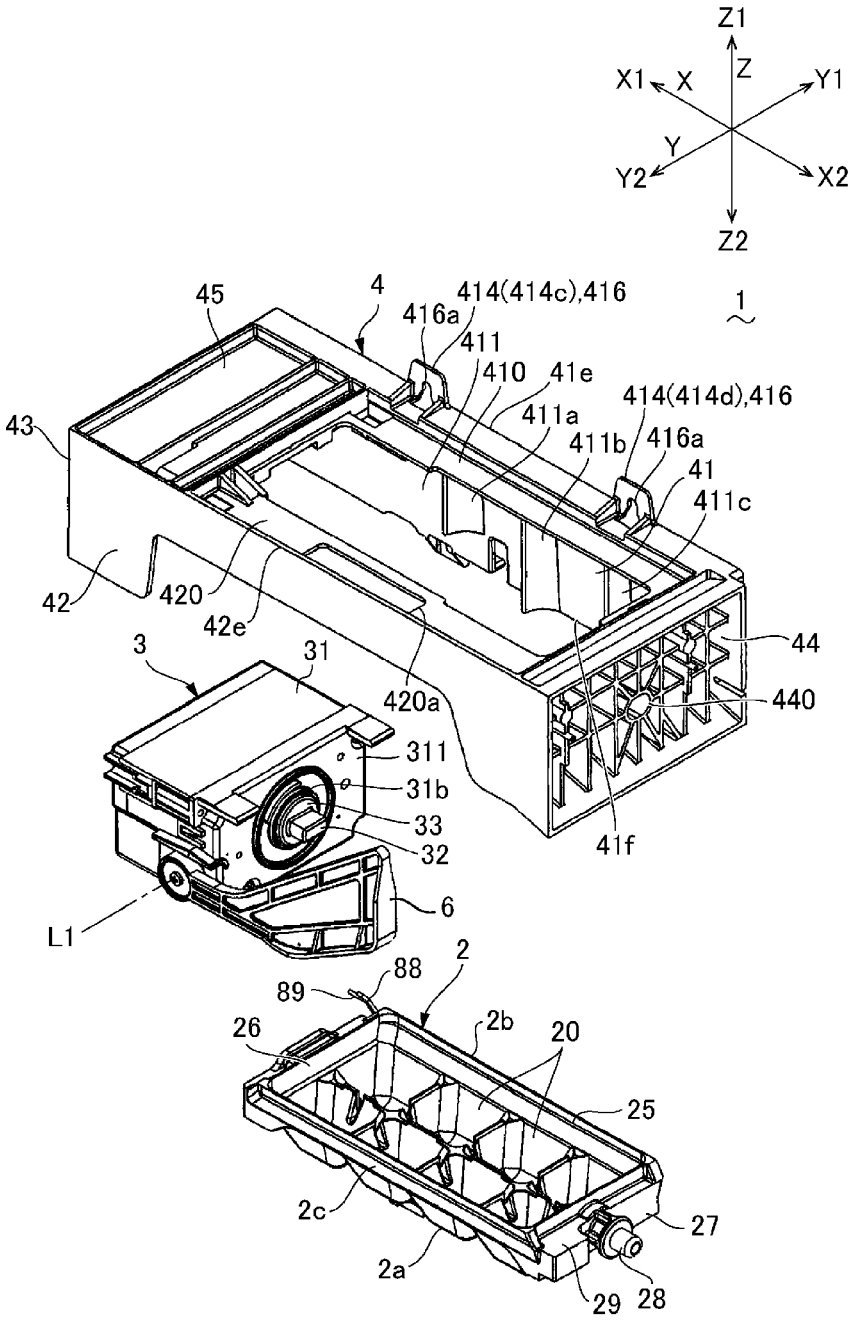
FIG. 2 is an exploded perspective view of the ice making device shown in FIG. 1 when viewed from the side on which the second side plate is disposed and viewed obliquely from above.
Figure 3:
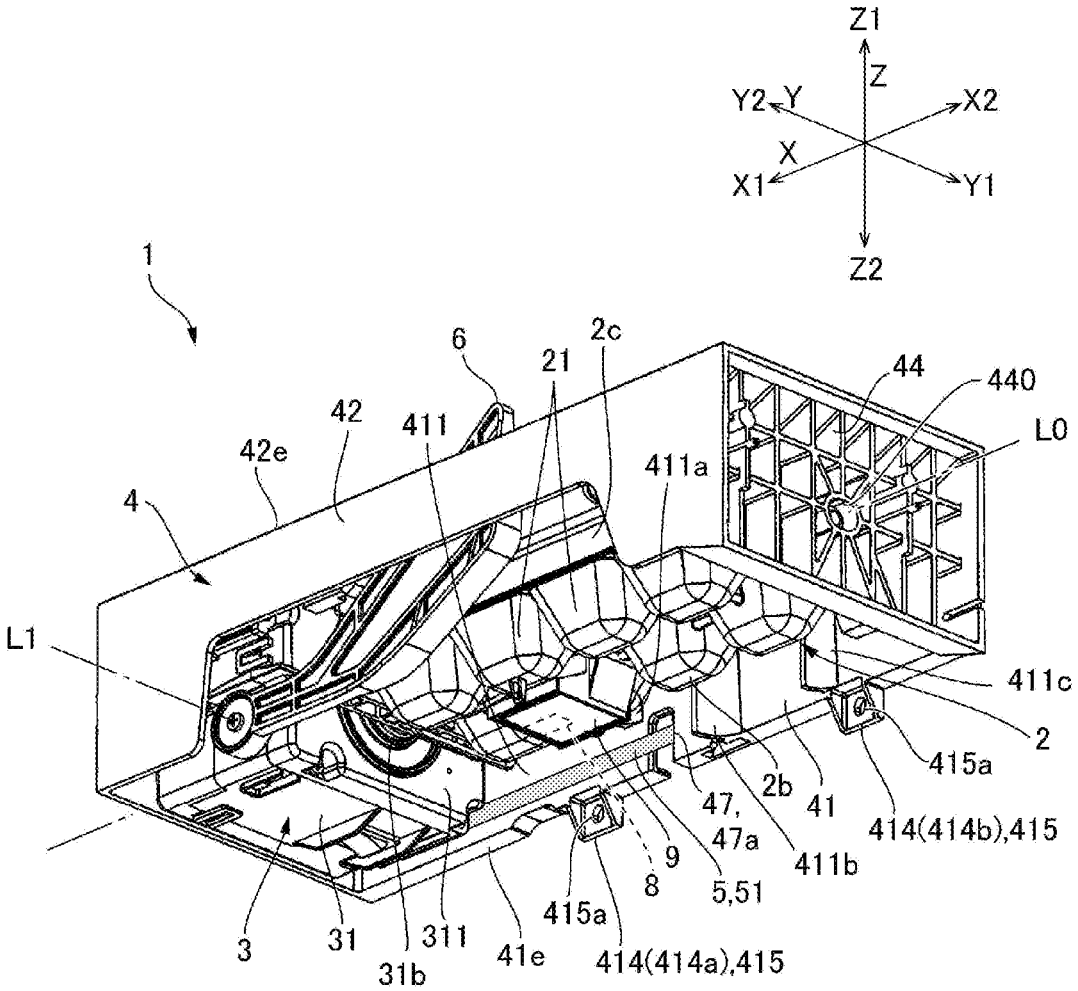
FIG. 3 is an exploded perspective view of the ice making device shown in FIG. 1 when viewed from the side on which the second side plate is disposed and viewed obliquely from below.
Figure 4:
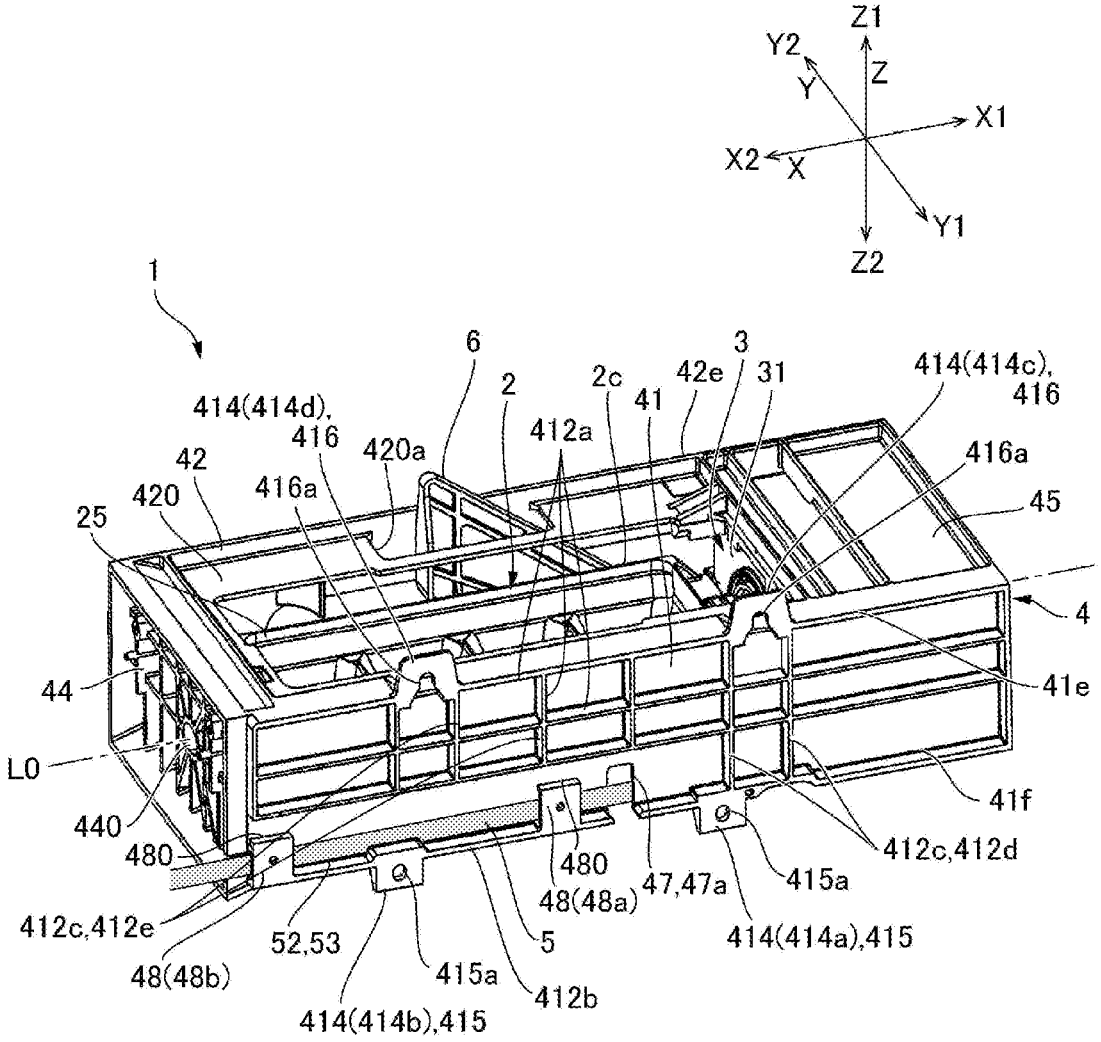
FIG. 4 is a perspective view of the ice making device shown in FIG. 1 when viewed from the side on which a first side plate is disposed and viewed obliquely from above.
Figure 5:
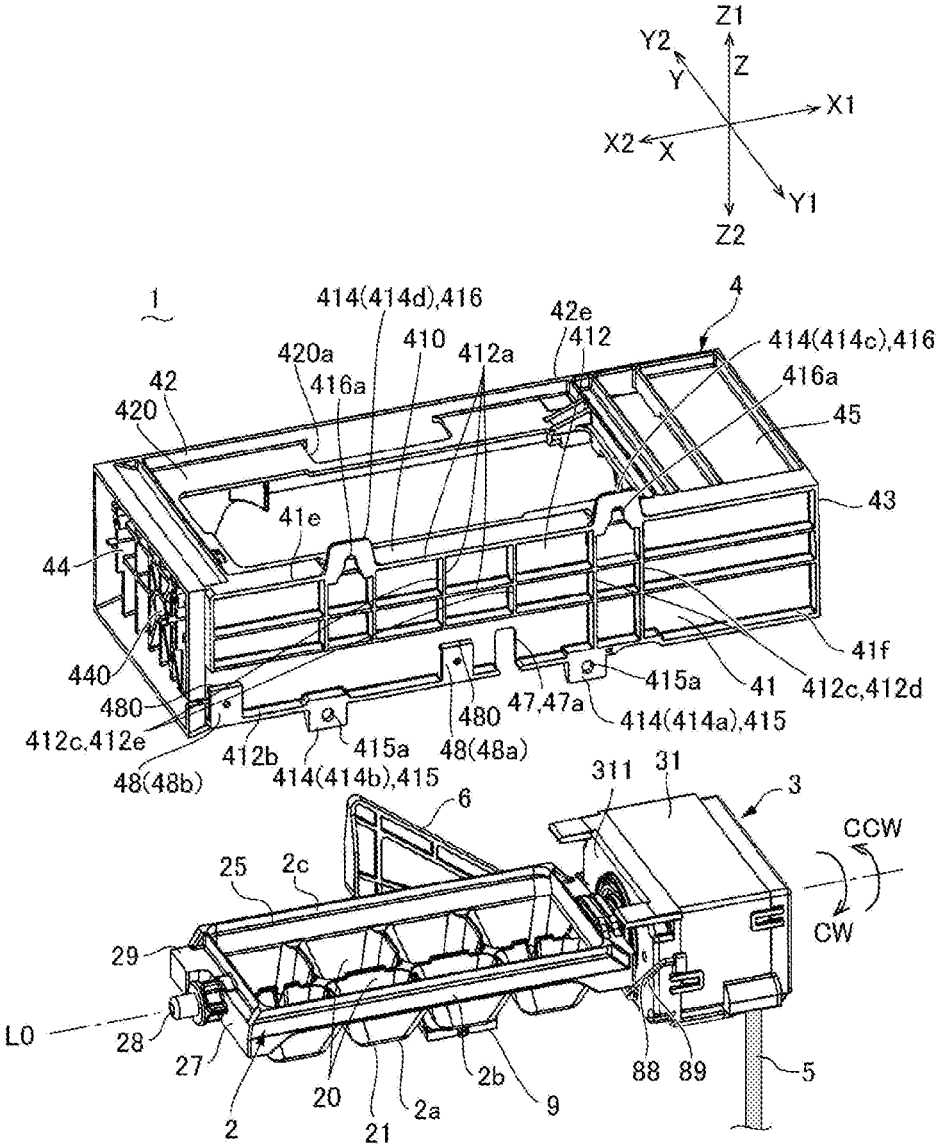
FIG. 5 is an exploded perspective view of the ice making device shown in FIG. 1 when viewed from the side on which the first side plate is disposed and viewed obliquely from above.
Figure 6:
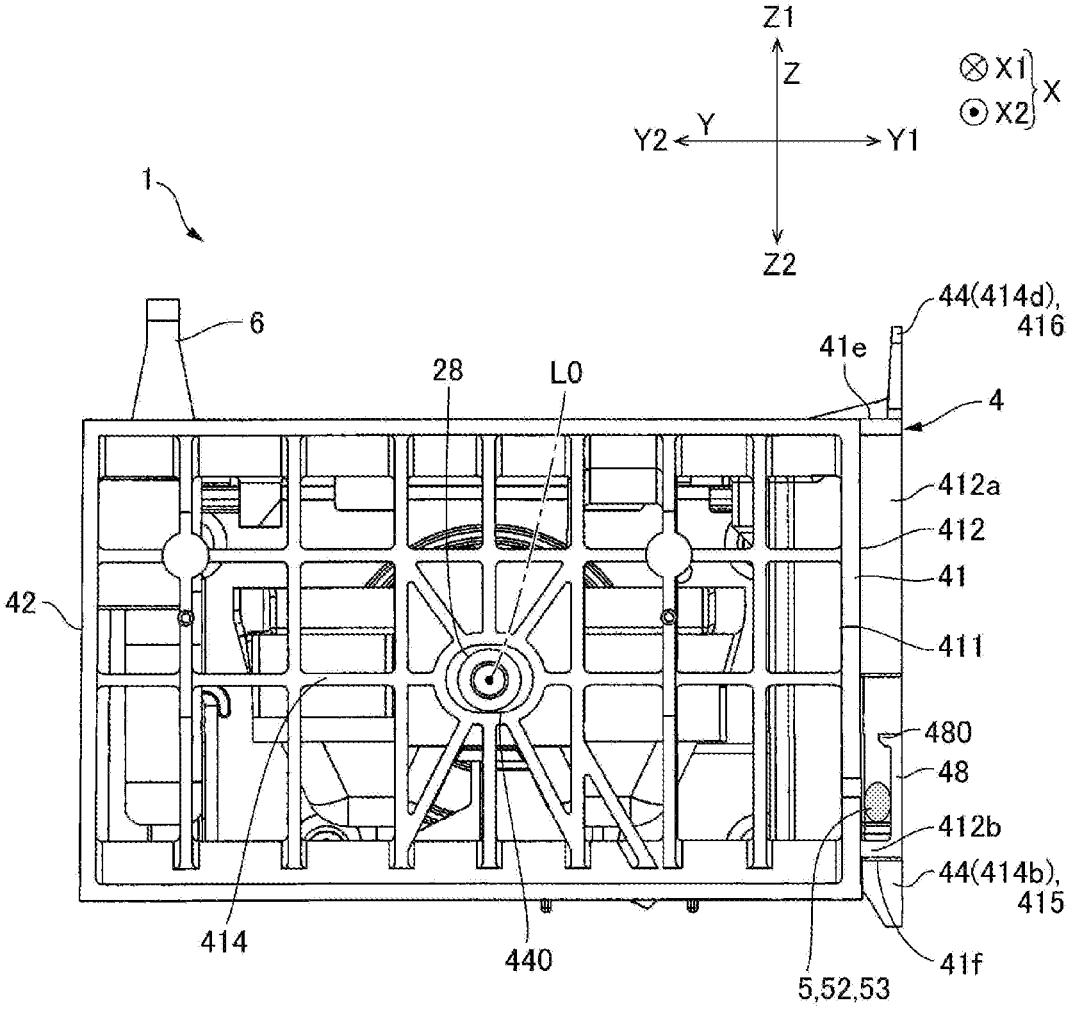
FIG. 6 shows a side part of the ice making device shown in FIG. 1 when viewed from the side opposite to a drive unit.

FIG. 1 is a perspective view of an ice making device 1 to which an embodiment of the disclosure is applied when viewed from the side on which a second side plate 42 is disposed and viewed obliquely from above. FIG. 2 is an exploded perspective view of the ice making device 1 shown in FIG. 1 when viewed from the side on which the second side plate 42 is disposed and viewed obliquely from above. FIG. 3 is an exploded perspective view of the ice making device 1 shown in FIG. 1 when viewed from the side on which the second side plate 42 is disposed and viewed obliquely from below. FIG. 4 is a perspective view of the ice making device 1 shown in FIG. 1 when viewed from the side on which a first side plate 41 is disposed and viewed obliquely from above. FIG. 5 is an exploded perspective view of the ice making device 1 shown in FIG. 1 when viewed from the side on which the first side plate 41 is disposed and viewed obliquely from above. FIG. 6 shows a side part of the ice making device 1 shown in FIG. 1 when viewed from the side opposite to a drive unit 3.

The ice making device 1 shown in FIG. 1 to FIG. 6 includes an ice making tray 2 in which recessed parts for water storage 20 (cells) are disposed toward the one side Z1 (upper side) in the third direction Z, the drive unit 3 that is disposed on the one side X1 of the ice making tray 2 in the first direction X, and a frame 4 that supports the ice making tray 2 and the drive unit 3. The ice making device 1 is mounted on a refrigerator main body (not shown). In the refrigerator, water in a water supply tank (not shown) is filled into the recessed parts for water storage 20 of the ice making tray 2 through a water supply pipe (not shown) and ice making is performed. Then, when the ice making is completed, the drive unit 3 causes the ice making tray 2 to perform an inversion operation around an axis L0 that extends in the first direction X and a twist operation, and thereby causes ice in the ice making tray 2 to fall into an ice storage container (not shown).

(Configuration of Ice Making Tray 2)

As shown in FIG. 1, FIG. 2 and FIG. 3, the ice making tray 2 is a member that is made of a resin material and molded to have a substantially rectangular planar shape, and is made of an elastically deformable material. In the ice making tray 2, regarding the recessed parts for water storage 20, inside the frame part 25 having a substantially rectangular shape, two recessed parts for water storage 20 arranged in the second direction Y as a set are disposed in four rows in the first direction X. In the frame part 25 of the ice making tray 2, a connecting part (not shown) connected to an output shaft 32 of the drive unit 3 is formed on a wall part 26 that is disposed on the one side X1 in the first direction X, and a shaft part 28 that is rotatably supported on the frame 4 is formed on a wall part 27 that is disposed on the other side X2 in the first direction X. On the wall part 27 of the ice making tray 2, a rotation regulating part 29 that comes in contact with the frame 4 when the ice making tray 2 rotates around the axis L0 is formed. The rotation regulating part 29 causes the ice making tray 2 to perform a twist operation by preventing rotation of the ice making tray 2.

In the ice making tray 2, a convex part 21 reflecting the shape of the recessed part for water storage 20 is arranged on a bottom surface 2*a* in the third direction Z. On the bottom surface 2*a* of the ice making tray 2, a thermistor 8 configured to detect a temperature of the ice making tray 2 is disposed. The thermistor 8 is covered with a cover 9 that is fixed to the bottom surface 2*a* of the ice making tray 2. Signal wirings 88 and 89 extend from the thermistor 8 into the drive unit 3.

(Configuration of Drive Unit 3)

As shown in FIG. 2 and FIG. 5, the drive unit 3 includes a motor (not shown) serving as a driving source, a rotation transmission mechanism (not shown) configured to transmit a rotation force of the motor, and a cam gear 33 to which a rotation force of the motor is transmitted by the rotation transmission mechanism inside a case 31 molded in a rectangular parallelepiped shape. A wiring 5 for power supply to the motor is drawn out from the drive unit 3 to the outside of the frame 4. In the cam gear 33, the output shaft 32 to which a connecting part of the ice making tray 2 is connected is integrally molded. The output shaft 32 protrudes from a hole 316 provided on an end plate 311 of the case 31 to the outside of the case 31. As shown in FIG. 5, when ice in the ice making tray 2 is removed, the output shaft 32 rotates around the axis L0 in a clockwise CCW direction, and when the ice making tray 2 is returned to an original position, the output shaft 32 rotates in a counter-clockwise CW direction.

An ice detection lever 6 is disposed at a position adjacent to the ice making tray 2 on the other side Y2 in the second direction Y. In the case 31 of the drive unit 3, an ice detection mechanism causing the ice detection lever 6 to rotate around the axis L1 and operate in connection with the cam gear 33 according to a rotation angle of the cam gear 33, a switch mechanism that operates based on a signal input from the thermistor 8 through the signal wirings 88 and 89, and the like are provided.

(Configuration of Frame 4)

As shown in FIG. 3, FIG. 4 and FIG. 5, the frame 4 includes a first side plate 41 that extends in the first direction X along a first side surface 2*b* of the ice making tray 2 on one side Y1 in the second direction Y, and the second side plate 42 that extends in the first direction X along a second side surface 2*c* of the ice making tray 2 on the other side Y2 in the second direction Y. The first side plate 41 and the second side plate 42 face each other in parallel in the second direction Y. The ice detection lever 6 is disposed between the second side plate 42 and the ice making tray 2.

From an upper end 41*e* (edge on the one side Z1 in the third direction Z) of the first side plate 41, a first upper plate part 410 projects toward the second side plate 42. The first upper plate part 410 is bent downward at an intermediate position toward the other side Y2 in the second direction Y and then projects toward the second side plate 42. From the vicinity of an upper end 42*e* (edge on the one side Z1 in the third direction Z) of the second side plate 42, a second upper plate part 420 projects toward the first side plate 41. The ice making tray 2 faces upward in an open state (the one side Z1 in the third direction Z) between the first upper plate part 410 and the second upper plate part 420. An opening 420*a* is formed in the second upper plate part 420. The upper end part of the ice detection lever 6 is disposed inside the opening 420*a*.

Ends of the first side plate 41 and the second side plate 42 on the one side X1 in the first direction X overlap the drive unit 3 when viewed in the second direction Y. The first side plate 41 and the second side plate 42 are connected by a plate-like first wall part 43 that is disposed at an end on the one side X1 in the first direction X and a second wall part 44 that is disposed at an end on the other side X2 in the first direction X. The first side plate 41 and the second side plate 42 are also connected by an upper plate part 45 that covers the drive unit 3 from the upper side on the one side Y1 in the second direction Y. The second wall part 44 is a porous wall in which a plurality of plate-like ribs are connected to each other, and a shaft hole 440 that rotatably supports the shaft part 28 of the ice making tray 2 is formed at the center thereof.

(Detailed Configuration of First Side Plate 41 or the Like)

As shown in FIG. 3, on a wall (an inner wall 411) on the side on which the ice making tray 2 is disposed in the first side plate 41, a plurality of inner wall side reinforcing ribs 411*a*, 411*b*, and 411*c* that extend in a vertical direction are formed in the first direction X. Among the plurality of inner wall side reinforcing ribs 411*a*, 411*b*, and 411*c*, the inner wall side reinforcing rib 411*a* (first inner wall side reinforcing rib) that is disposed on the one side X1 of a notch 47*a* to be described below in the first direction X extends from a position on the side of the upper end 41*e* connected to the first upper plate part 410 in the inner wall 411 to an intermediate position toward a lower end 41*f* (edge on the other side Z2 in the third direction Z). On the other hand, the inner wall side reinforcing ribs 411*b* and 411*c* (second inner wall side reinforcing rib) that are disposed on the other side X2 of the notch 47*a* in the first direction X extend from a position on the side of the upper end 41*e* connected to the first upper plate part 410 in the inner wall 411 to the lower end 41*f*.

On a wall (an outer wall 412) on the side opposite to the ice making tray 2 in the first side plate 41, an outer wall side reinforcing rib 412*a* that protrudes toward the one side Y1 (outside) in the second direction Y is formed to extend in the first direction X and the third direction Z. In the outer wall side reinforcing rib 412*a*, a plurality of outer wall side reinforcing ribs 412*c* that extend in the vertical direction are included, and the plurality of outer wall side reinforcing ribs 412*c* are formed in the first direction X. Among the plurality of outer wall side reinforcing ribs 412*c*, an outer wall side reinforcing rib 412*d* (first outer wall side reinforcing rib) that is disposed on the one side X1 of the notch 47*a* in the first direction X to be described below extends from the upper end 41*e* to the lower end 41*f* of the outer wall 412. On the other hand, an outer wall side reinforcing rib 412*e* (second outer wall side reinforcing rib) that is disposed on the other side X2 of the notch 47*a* in the first direction X extends from the upper end 41*e* of the outer wall 412 to an intermediate position toward the lower end 41*f* (edge on the other side Z2 in the third direction Z). In addition, in the lower end 41*f* of the first side plate 41 (edge on the other side Z2 in the third direction Z), a reinforcing rib 412*b* that protrudes toward the one side Y1 (outside) in the second direction Y is formed to extend in the first direction X along the lower end 41*f* of the first side plate 41. In the present embodiment, sizes of the outer wall side reinforcing rib 412*a* and the reinforcing rib 412*b* that protrude to the one side Y1 in the second direction Y are the same.

In the outer wall 412 of the first side plate 41, on the other side X1 of the drive unit 3 in the first direction X, a plurality of attachment parts 414 that fix the frame 4 to a refrigerator main body when the ice making device 1 is mounted on the refrigerator main body (not shown), a penetration part 47 through which the wiring 5 is drawn from the inside of the frame 4 to the outside, and a wiring supporting part 48 that supports the wiring 5 drawn out to the outside along the outer wall 412 are provided.

In the present embodiment, as the plurality of attachment parts 414, a first lower end side attachment part 414*a*, and a second lower end side attachment part 414*b* that are formed at positions separated in the first direction X in the lower end 41*f* of the first side plate 41 are formed. The first lower end side attachment part 414*a* and the second lower end side attachment part 414*b* are formed of a plate 415 that protrudes downward from the reinforcing rib 412*b*. In the plate 415, a hole 415*a* for fixing the frame 4 to the refrigerator main body by a screw is formed. The first lower end side attachment part 414*a* and the second lower end side attachment part 414*b* (the plate 415) do not protrude to one side Y2 of the reinforcing rib 412*b* in the second direction Y.

In the present embodiment, in addition, as the plurality of attachment parts 414, a first upper end side attachment part 414*c* and a second upper end side attachment part 414*d* that are formed at positions separated in the first direction X in the upper end 41*e* of the first side plate 41 are formed. The first upper end side attachment part 414*c* and the second upper end side attachment part 414*d* are formed of a plate 416 that protrudes upward from the outer wall side reinforcing rib 412*a*. In the plate 416, a hole 416*a* for disposing the frame 4 to the refrigerator main body by a screw is formed. In the present embodiment, the hole 416*a* has a shape that is enlarged downward from a hole for fastening a screw. Therefore, after the screw passes through the hole 416*a*, when the frame 4 is moved so that the screw moves to an upper end part of the hole 416*a*, positioning of the frame 4 in the first direction X and the vertical direction can be performed. In the present embodiment, the first upper end side attachment part 414*c* and the second upper end side attachment part 414*d* (the plate 416) do not protrude to one side Y2 of the outer wall side reinforcing rib 412*a* in the second direction Y.

The four attachment parts 414 are provided at positions shifted in the first direction X. From the one side X1 to the other side X2 in the first direction X, the first upper end side attachment part 414*c*, the first lower end side attachment part 414*a*, the second upper end side attachment part 414*d*, and the second lower end side attachment part 414*b* are provided in that order.

Through the penetration part 47, the first side plate 41 penetrates in the second direction Y on the other side X2 in the first direction X relative to the first upper end side attachment part 414*c* provided furthest on one side X1 in the first direction X among the plurality of attachment parts 414. In the present embodiment, the penetration part 47 is constituted by the notch 47*a* formed in the lower end 41*f* of the first side plate 41. Here, the penetration part 47 is formed between two attachment parts 414 (the first lower end side attachment part 414*a* and the second lower end side attachment part 414*b*) adjacent to each other in the first direction X in the lower end 41*f* of the first side plate 41 and between two attachment parts 414 (the first upper end side attachment part 414*c* and the second upper end side attachment part 414*d*) adjacent to each other in the first direction X in the upper end 41*e* of the first side plate 41. Therefore, on the one side X1 of the penetration part 47 in the first direction X, the first lower end side attachment part 414*a* that is formed in the lower end 41*f* of the first side plate 41 and the first upper end side attachment part 414*c* that is formed in the upper end 41*e* of the first side plate 41 are present.

In the ice making device 1 configured as described above, the wiring 5 that extends from the drive unit 3 passes between the inner wall side reinforcing rib 411*a* (first inner wall side reinforcing rib) formed on the inner wall 411 of the first side plate 41 and the lower end 41*f* inside the first side plate 41 and is drawn around the other side X2 in the first direction X along the lower end 41*f*, and is then drawn out to the outside of the first side plate 41 through the penetration part 47. Therefore, the wiring 5 includes a first drawing part 51 that extends from the drive unit 3 along the inner wall 411 of the first side plate 41 and a second drawing part 52 that is drawn out to the outside (side opposite to the ice making tray 2) of the first side plate 41 through the penetration part 47. Accordingly, since an intermediate part of the wiring 5 is supported by the penetration part 47 of the first side plate 41, the wiring 5 disposed outside the frame 4 becomes shorter. Therefore, handling of the wiring 5 and the like become easier.

In addition, the second drawing part 52 includes a third drawing part 53 that extends along the outer wall 412 of the first side plate 41, and the third drawing part 53 passes between the outer wall side reinforcing rib 412*e* (second outer wall side reinforcing rib) formed on the outer wall 412 of the first side plate 41 and the lower end 41*f* and is drawn around the other side X2 in the first direction X along the lower end 41*f*. In the lower end 41*f* of the first side plate 41, the wiring supporting part 48 that supports the third drawing part 53 is provided. The wiring supporting part 48 protrudes upward (the one side Z1 in the third direction Z) from the lower end 41*f* of the first side plate 41 so that it forms a gap for maintaining the third drawing part 53 with the outer wall 412. The wiring supporting part 48 is plate-like and is elastically deformable in the second direction Y. Accordingly, the third drawing part 53 is pressed elastically against the outer wall 412. In addition, the wiring supporting part 48 includes a locking claw part 480 that is bent toward the outer wall 412 at its tip part. The wiring supporting part 48 does not protrude to the one side Y1 of the outer wall side reinforcing rib 412*a* in the second direction Y. Accordingly, even if the second drawing part 52 of the wiring 5 (the third drawing part 53) is passed between the outer wall 412 and the wiring supporting part 48, the wiring 5 does not protrude to the one side Y1 of the outer wall side reinforcing rib 412*a* in the second direction Y. Therefore, even if the wiring 5 is drawn around to follow the outer wall 412 of the first side plate 41, when the frame 4 is installed to the refrigerator main body, the frame 4 is unlikely to be lifted due to the wiring 5.

In the present embodiment, the wiring supporting part 48 is formed of a first wiring supporting part 48*a* that is formed between the first lower end side attachment part 414*a* and the second lower end side attachment part 414*b* and a second wiring supporting part 48*b* that is formed on the other side X2 of the second lower end side attachment part 414*b* in the first direction X in the lower end 41*f* of the first side plate 41.

(Operations)

In the ice making device 1 of the present embodiment, the frame 4 is fixed to the refrigerator main body by the four attachment parts 414 and the ice making device 1 is mounted on the refrigerator main body.

In this state, in the ice making tray 2, ice making is performed. In an ice making process, water is supplied to the ice making tray 2 in which the recessed parts for water storage 20 are horizontally disposed upward through a water supply pipe (not shown), and water is filled into the recessed parts for water storage 20. Then, water filled into the ice making tray 2 is cooled by a cooling part (not shown) that is provided above the ice making tray 2. Determination of whether ice making is completed is performed according to determination of whether a temperature of the ice making tray 2 is equal to or lower than a predetermined temperature by the thermistor 8 installed to the ice making tray 2.

When the ice making is completed, an amount of ice in an ice storage container (not shown) provided below the ice making tray 2 is detected by the ice detection lever 6. Specifically, the ice detection lever 6 is driven by the drive unit 3 and lowered. In this case, when the ice detection lever 6 is lowered to a predetermined position, it is determined that the ice storage container is not full of ice. On the other hand, when the ice detection lever 6 comes in contact with ice in the ice storage container before the ice detection lever 6 is lowered to a predetermined position, it is determined that the ice storage container is full of ice. When the ice storage container is full of ice, a predetermined time is waited and then again an amount of ice in the ice storage container is detected by the ice detection lever 6.

When the ice storage container is not full of ice, ice in the ice making tray 2 is removed. Specifically, when the output shaft 32 of the drive unit 3 is driven to rotate, the ice making tray 2 rotates around the axis L0. When the ice making tray 2 rotates to a predetermined rotation angle (for example, 120°) of 90° or more from the first position horizontally disposed, the rotation regulating part 29 of the ice making tray 2 comes in contact with the frame 4. In this state, even if the ice making tray 2 tries to further rotate, rotation is prevented, and the ice making tray 2 is twisted and deformed. Accordingly, ice in the ice making tray 2 is removed from the ice making tray 2, and falls into the ice storage container (not shown) provided below the ice making tray 2.

Thereafter, the drive unit 3 reversely rotates the ice making tray 2 so that the recessed parts for water storage 20 face upward, and the above operation is repeated.

Main Effects of Present Embodiment

When the drive unit 3 causes the ice making tray 2 to perform a twist operation in order to perform the above ice removal operation, a large force is applied to the frame 4 due to a reaction force. However, in the first side plate 41, among the plurality of attachment parts 414 provided on the other side X2 of the drive unit 3 in the first direction X, the penetration part 47 is provided on the other side X2 of the first upper end side attachment part 414*c* in the first direction X provided furthest on one side X1 in the first direction X. In particular, in the present embodiment, the penetration part 47 is constituted by the notch 47*a* formed in the lower end 41*f* of the first side plate 41. The penetration part 47 is formed between two attachment parts 414 (the first lower end side attachment part 414*a* and the second lower end side attachment part 414*b*) adjacent to each other in the first direction X in the lower end 41*f* of the first side plate 41. Therefore, on the one side X1 of the penetration part 47 in the first direction X, the first lower end side attachment part 414*a* that is formed in the lower end 41*f* of the first side plate 41 and the first upper end side attachment part 414*c* that is formed in the upper end 41*e* of the first side plate 41 are present. Both the first lower end side attachment part 414*a* and the first upper end side attachment part 414*c* are fixed to the refrigerator main body. Therefore, transmission of a force applied to the frame 4 when the drive unit 3 causes the ice making tray 2 to perform a twist operation to the side of the penetration part 47 of the first side plate 41 is prevented by the attachment part 414 (the first upper end side attachment part 414*c* and the first lower end side attachment part 414*a*) provided on the one side X1 of the penetration part 47 in the first direction X. Accordingly, in the second side plate 42, since concentration of stress in the vicinity of the penetration part 47 can be prevented, it is possible to prevent the second side plate 42 from being damaged in the vicinity of the penetration part 47.

In addition, the second drawing part 52 of the wiring 5 includes the third drawing part 53 that extends along the outer wall 412 of the first side plate 41. In the first side plate 41, the wiring supporting part 48 that supports the third drawing part 53 is provided. Therefore, since a wiring part which is free outside the frame 4 is shortened, handling and the like of the wiring 5 become easier. In addition, the wiring supporting part 48 elastically presses the third drawing part 53 against the outer wall 412. Accordingly, when the third drawing part 53 is passed between the outer wall 412 and the wiring supporting part 48, since the third drawing part 53 is supported by the first side plate 41, the third drawing part 53 is easily supported.

In addition, since the penetration part 47 is provided in the lower end 41*f* of the first side plate 41, the wiring 5 can be drawn along the lower end 41*f* of the first side plate 41. Accordingly, the wiring 5 is less likely to interfere with provision of a water supply pipe through which water is supplied to the ice making tray 2 and the like.

In addition, inside the first side plate 41, among the plurality of inner wall side reinforcing ribs 411*a*, 411*b*, and 411*c*, the inner wall side reinforcing rib 411*a* (first inner wall side reinforcing rib) that is disposed on the one side X1 of the notch 47*a* in the first direction X extends to an intermediate position toward the lower end 41*f* from the side of the upper end 41*e*, and the inner wall side reinforcing ribs 411*b* and 411*c* (second inner wall side reinforcing rib) that are disposed on the other side X2 of the notch 47*a* in the first direction X extend to the lower end 41*f* from the side of the upper end 41*e*. Therefore, inside the first side plate 41, the first drawing part 51 of the wiring 5 can be drawn between the inner wall side reinforcing rib 411*a* (first inner wall side reinforcing rib) and the lower end 41*f*. Therefore, the strength of the first side plate 41 can be increased by the inner wall side reinforcing ribs 411*a*, 411*b*, and 411*c* while a space in which the first drawing part 51 is disposed is secured.

In addition, outside the first side plate 41, among a plurality of outer wall side reinforcing ribs 421*c*, an outer wall side reinforcing rib 421*d* (first outer wall side reinforcing rib) that is disposed on the one side X1 of the notch 47*a* in the first direction X extends to the lower end 41*f* from the side of the upper end 41*e*, and an outer wall side reinforcing rib 421*e* (second outer wall side reinforcing rib) that is disposed on the other side X2 of the notch 47*a* in the first direction X extends to an intermediate position toward the lower end 41*f* from the side of the upper end 41*e*. Therefore, the third drawing part 53 can be drawn between the outer wall side reinforcing rib 412*e* (second outer wall side reinforcing rib) and the lower end 41*f*. Therefore, the strength of the first side plate 41 can be increased by the plurality of outer wall side reinforcing ribs 421*c* while a space in which the third drawing part 53 is disposed is secured.

In addition, on the one side X1 of the notch 47*a* in the first direction X, the inner wall side reinforcing rib 411*a* of the inner wall 411 has not reached the lower end 41*f*. However, the outer wall side reinforcing rib 412*d* of the outer wall 412 has reached the lower end 41*f*. On the other hand, on the other side X2 of the notch 47*a* in the first direction X, the outer wall side reinforcing rib 412*e* of the outer wall 412 has not reached the lower end 41*f*. However, the inner wall side reinforcing ribs 411*b* and 411*c* of the inner wall 411 have reached the lower end 41*f*. Accordingly, the strength of the first side plate 41 can be increased even if a space in which the first drawing part 51 and the third drawing part 53 are disposed is secured in the inner wall 411 and the outer wall 412.

In addition, in the first side plate 41, since the inner wall side reinforcing ribs 411*a* and 411*b*, and the outer wall side reinforcing ribs 412*d* and 412*e* are formed to the vicinity of the notch 47*a*, the strength of the first side plate 41 can be increased.

Another Embodiment

Figure 7:
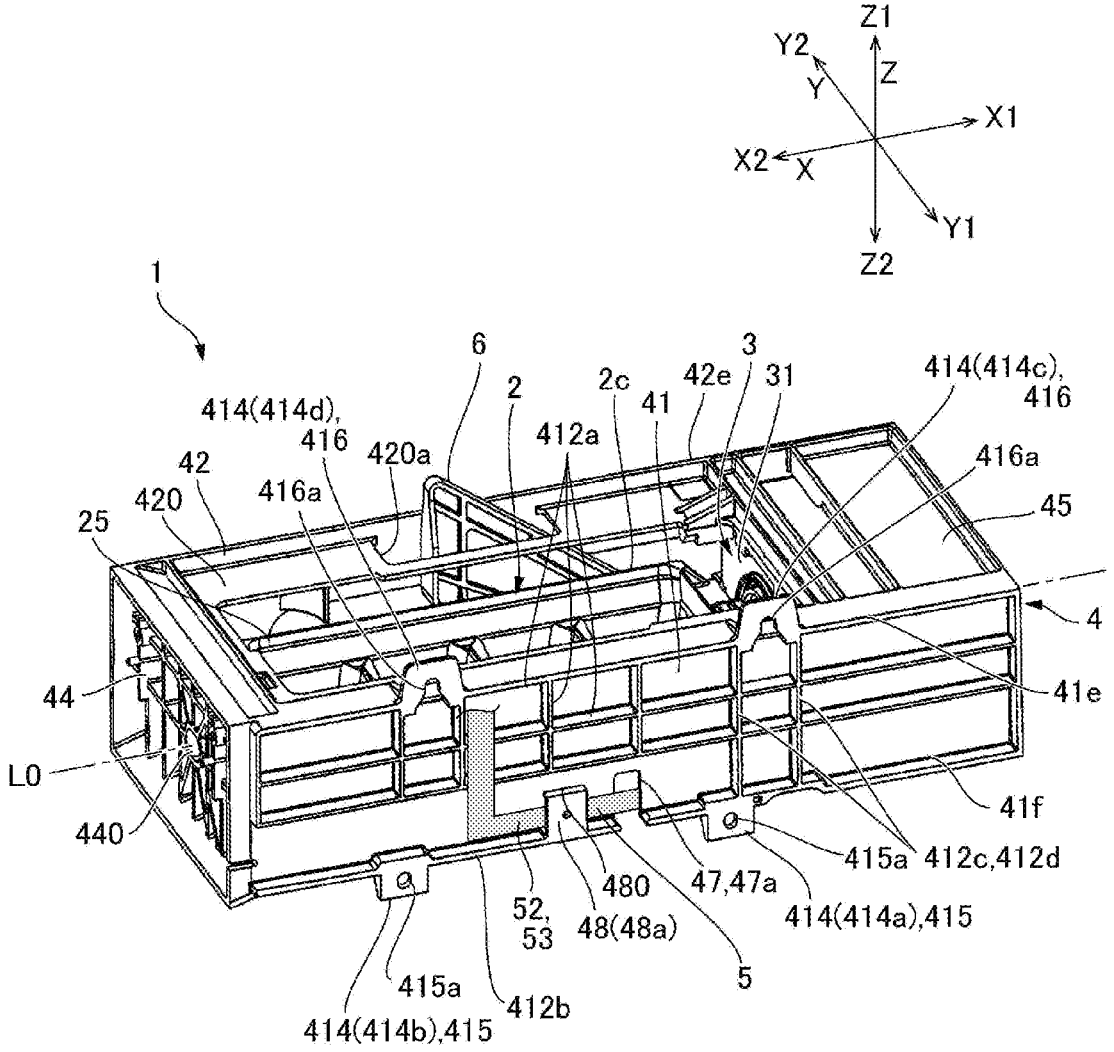
FIG. 7 is a perspective view of an ice making device according to another embodiment of the disclosure.

FIG. 7 is a perspective view of an ice making device 1 according to another embodiment of the disclosure. In the ice making device 1 described with reference to FIG. 1 to FIG. 6, the second drawing part 52 extends along the lower end 41*f* of the first side plate 41. However, as shown in FIG. 7, the second drawing part 52 may also extend upward from a midpoint.

Other Embodiments

While the four attachment parts 414 are provided in the embodiment described with reference to FIG. 1 to FIG. 6, when one attachment part 414 is provided in the lower end 41*f* of the first side plate 41 and two attachment parts 414 are provided in the upper end 41*e* of the first side plate 41, in the lower end 41*f* of the first side plate 41, the penetration part 47 may be provided on the other side X2 of the attachment part 414 in the first direction X provided in the lower end 41*f* of the first side plate 41. That is, in FIG. 4, the first lower end side attachment part 414*a*, the first upper end side attachment part 414*c*, the second upper end side attachment part 414*d*, and the penetration part 47 may be provided without providing the second lower end side attachment part 414*b*.

In addition, when two attachment parts 414 are provided in the lower end 41*f* of the first side plate 41 and one attachment part 414 is provided in the upper end 41*e* of the first side plate 41, in the lower end 41*f* of the first side plate 41, the penetration part 47 may be provided between two attachment parts 414 provided in the lower end 41*f* of the first side plate 41. That is, in FIG. 4, the first lower end side attachment part 414*a*, the second lower end side attachment part 414*b*, the first upper end side attachment part 414*c*, and the penetration part 47 may be provided without providing the second upper end side attachment part 414*d*, or the first lower end side attachment part 414*a*, the second lower end side attachment part 414*b*, the second upper end side attachment part 414*d*, and the penetration part 47 may be provided without providing the first upper end side attachment part 414*c*.

While the penetration part 47 (the notch 47*a*) is formed in the lower end 41*f* of the first side plate 41 in the above embodiment, the penetration part 47 (the notch 47*a*) may also be formed in the upper end 41*e* of the first side plate 41.

While the penetration part 47 is the notch 47*a* in the above embodiment, the penetration part 47 may be a hole.

What is claimed is:

1. An ice making device comprising:

an ice making tray in which recessed parts for water storage are disposed upward;

a drive unit, which comprises a motor and is disposed on one side of the ice making tray in a first direction crossing a vertical direction and causes the ice making tray to perform an inversion operation and a twist operation around an axis that extends in the first direction;

a frame that comprises a side plate that extends in the first direction along a side surface on one side of the ice making tray in a second direction crossing the vertical direction and the first direction and supports the ice making tray and the drive unit; and a wiring that extends from the drive unit, wherein a plurality of attachment parts and a penetration part are provided in the side plate, the attachments parts for installing the frame to a refrigerator main body is provided the side plate on an other side of the drive unit in the first direction the penetration part penetrates through the side plate in the second direction on the other side in the first direction relative to an attachment part provided furthest on the one side in the first direction among the plurality of attachment parts, and wherein the wiring comprises a first drawing part that extends from the drive unit along an inner wall of the side plate on which the ice making tray is disposed and a second drawing part that is drawn out to a side opposite to the ice making tray with respect to the side plate through the penetration part.

2. The ice making device according to claim 1, wherein the second drawing part comprises a third drawing part that extends along an outer wall of the side plate that is at a side opposite to the ice making tray, and wherein, in the side plate, a wiring supporting part that supports the third drawing part is provided.

3. The ice making device according to claim 2, wherein the wiring supporting part elastically presses the third drawing part against the outer wall.

4. The ice making device according to claim 1, wherein the penetration part is a notch that is provided at a lower end or an upper end of the side plate.

5. The ice making device according to claim 4, wherein the notch is provided at the lower end of the side plate.

6. The ice making device according to claim 5, wherein the plurality of attachment parts comprise at least a lower end side attachment part formed at the lower end of the side plate, and wherein the lower end side attachment part is provided on one side of the penetration part in the first direction.

7. The ice making device according to claim 5, wherein the plurality of attachment parts comprise at least a plurality of lower end side attachment parts formed at the lower end of the side plate, and wherein the penetration part is provided between lower end side attachment parts adjacent to each other in the first direction among the plurality of lower end side attachment parts.

8. The ice making device according to claim 5, wherein the plurality of attachment parts comprise a lower end side attachment part formed at the lower end of the side plate and an upper end side attachment part formed at the upper end of the side plate, and wherein the penetration part is provided between the lower end side attachment part and the upper end side attachment part in the first direction.

9. The ice making device according to claim 5, wherein, on the inner wall, a plurality of inner wall side reinforcing ribs that extend in the vertical direction are formed along the first direction, wherein, among the plurality of inner wall side reinforcing ribs, a first inner wall side reinforcing rib formed on one side of the notch in the first direction extends halfway toward the lower end from a side of the upper end of the side plate and a second inner wall side reinforcing rib formed on another side of the notch in the first direction reaches the lower end from a side of the upper end of the side plate, and wherein the first drawing part extends along the inner wall between the first inner wall side reinforcing rib and the lower end of the side plate.

10. The ice making device according to claim 5, wherein, on an outer wall of the side plate opposite to the ice making tray, a plurality of outer wall side reinforcing ribs that extend in the vertical direction are formed along the first direction, and wherein, among the plurality of outer wall side reinforcing ribs, a first outer wall side reinforcing rib formed on one side of the notch in the first direction reaches the lower end from a side of the upper end of the side plate and a second outer wall side reinforcing rib formed on an other side of the notch in the first direction extends halfway toward the lower end from a side of the upper end of the side plate.

* * * * *